US005437484A

United States Patent [19]

Yamada

[11] Patent Number: 5,437,484

[45] Date of Patent: Aug. 1, 1995

[54] LOCK HANDLE ASSEMBLY WITH DETACHABLE HANDLE

[75] Inventor: Kenichi Yamada, Tokyo, Japan

[73] Assignee: Takigen Manufacturing Co. Ltd., Tokyo, Japan

[21] Appl. No.: 197,062

[22] Filed: Feb. 16, 1994

[30] Foreign Application Priority Data

Mar. 31, 1993 [JP] Japan ..... 5-096904

[51] Int. Cl.[6] ..... E05B 65/44; E05C 1/08

[52] U.S. Cl. ..... 292/36; 70/455; 292/DIG. 53; 292/336.3

[58] Field of Search ..... 292/DIG. 27, 34–36, 292/37, 26, 48, DIG. 53, DIG. 54, 6, 7, 336.3; 70/113, 116, 18, 455, 232

[56] References Cited

U.S. PATENT DOCUMENTS

| | | | |
|---|---|---|---|
| 1,269,311 | 6/1918 | Rixson | 292/36 |
| 1,716,113 | 6/1929 | Carlson | 292/26 |
| 1,811,141 | 6/1931 | Leventhal | 70/455 |
| 3,054,484 | 9/1962 | Griffiths et al. | 292/36 |
| 3,895,506 | 7/1975 | Gallego | 292/48 |
| 3,899,907 | 8/1975 | Prahl | 70/452 |
| 4,113,291 | 9/1978 | Cameron | 70/DIG. 63 |
| 4,362,328 | 12/1982 | Tacheny et al. | 292/36 |
| 4,964,755 | 10/1990 | Lewis et al. | 292/336.3 |
| 5,033,696 | 7/1991 | Horstman | 292/7 |

FOREIGN PATENT DOCUMENTS

| | | | |
|---|---|---|---|
| 789747 | 8/1935 | France | 292/34 |
| 71956 | 11/1893 | Germany | 292/36 |
| 2353721 | 4/1975 | Germany | 292/36 |
| 3727925 | 3/1989 | Germany | 70/455 |
| 19370 | 7/1903 | United Kingdom | 70/36 |
| 1036317 | 7/1966 | United Kingdom | 70/455 |

*Primary Examiner*—Peter M. Cuomo
*Assistant Examiner*—Darnell M. Boucher
*Attorney, Agent, or Firm*—Martin Smolowitz

[57] ABSTRACT

There is provided a lock handle assembly with a detachable handle.

A mechanism provided in the assembly can perform a three-point locking up operation of a door 56. In the assembly: a rotor 12 has its rear-end portion fixed to a cam 16 which has its opposite ends connected with links *22a, 22b* each of which has its front end carry each of arms *23a, 23b* each of which has its front end carry each of rods *55a, 55b,* so that the arms *23a, 23b* are linearly moved back and forth as the cam rotates, whereby the rods *55a, 55b* have their front ends engaged with and disengaged from receiving portions 60, 61 of a stationary frame element 58. At the same time, a catch plate 37 fixed to a rear-end portion of the cam 16 is rotated as the cam rotates, so that the catch plate 37 is engaged with and disengaged from a receiving portion 59 of the stationary frame element 58.

4 Claims, 5 Drawing Sheets

LOCK HANDLE ASSEMBLY WITH DETACHABLE HANDLE

BACKGROUND OF THE INVENTION

1. Field of the Invention

The present invention relates to a lock handle assembly with a detachable handle, the assembly being used in doors of containers for receiving electrical instruments therein.

2. Description of the Prior Art

In a conventional lock handle assembly disclosed in Japanese Utility Model Laid-Open No. Sho 62-132936: a cover is slidably mounted on a front surface of a main body fixed to a door; a lock unit is fixedly mounted on the cover, and has its locking member projected from and retracted in a concave portion which is provided in a front, frame wall portion of the main body; the cover is slidably moved to cover a handle receiving hole of a front surface of the main body; the locking member of the lock unit is engaged with the concave portion of the main body so that the cover is locked up in a position in which the cover covers the handle receiving hole of the main body.

However, in such locking operation of the conventional handle assembly having the above construction, the catch plate having been fixed to the rear-end portion of the rotor is rotated to engage with the receiving portion of the stationary frame element. Consequently, it is not possible for the conventional handle assembly to perform a three-pint locking up of a door carrying the handle assembly.

SUMMARY OF THE INVENTION

It is an object of the present invention to provide a lock handle assembly with a detachable handle, the assembly being provided with a mechanism for performing a three-point locking up operation of a floor carrying the handle assembly.

According to a first aspect of the present invention, the above object of the present invention are accomplished by providing:

A lock handle assembly with a detachable handle, comprising:

a main body provided with a handle-insertion hole in its front surface;

a cover slidably mounted on the front surface of the main body;

a mounting plate for fixedly mounting the main body on a door;

a rotor which is provided with a handle-receiving hole in its front, surface and a square hole in its rear surface, and is rotatably mounted in a cylindrical portion of the main body;

a cam which is provided with a square-column portion and a threaded hole in its front-end portion, and a square-column portion and a threaded hole in its rear-end portion, and has its intermediate portion formed into a pair of flat-plate portions which are diametrically opposed to each other, the flat-plate portions being provided with through-holes, respectively;

links connected with the through-hole of the cam, respectively;

arms connected with a front end of the link and a front end of the link, respectively;

a casing provided with guides for the arms in its inner portion, the casing receiving the cam, the links and the arms therein; and a catch plate fixedly mounted on a rear-end portion of the cam;

wherein: the main body abuts on a front surface, of a door; the mount, log plate abuts on a rear surface of the door; a screw passes through a through-hole of the mounting plate and a through-hole of the door, and is threadably connected with a threaded hole of a rear wall of the main body so that the main body is fixedly mounted on the door; the square-column portion of the cam projecting from a front surface of the casing is inserted in the square hole of the rotor having been mounted in the cylindrical portion of the main body, and then a screw passing through a through-hole of a rear wall of the casing is threadably connected with a threaded hole of a rear surface of the mounting plate, so that the main body is fixedly mounted on the casing; and, the catch plate is fixedly mounted on the square-column portion of the cam projecting from a rear surface of the casing.

According to a second aspect, of the present invention, the above object of the present invention are accomplished by providing:

The lock handle assembly wherein:

each of the through-holes of the flat-plate portions of the cam is provided in each of off-set positions relative to each of longitudinal axes of the arms, so that when each of the arms is projected from each of the opposite ends of the casing to a maximum extent, each of the flat-plate portions of the intermediate shaft portion of the cam abuts against each of guide convex portions of an inner portion of the casing to prevent the cam from reversely rotating.

DESCRIPTION OF THE PREFERRED EMBODIMENTS

Figure 1:
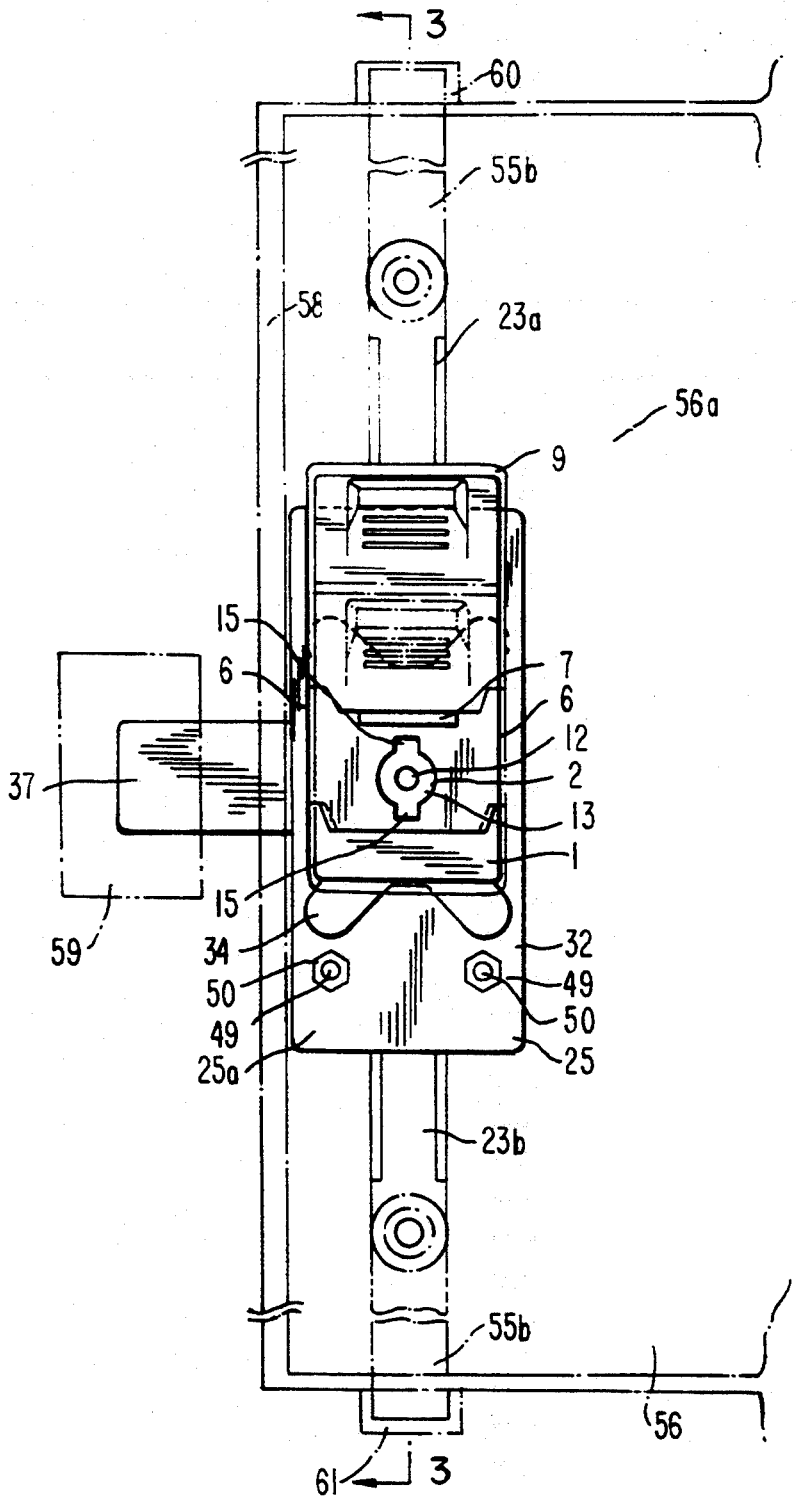
FIG. 1 is a front view of an embodiment of the lock handle assembly of the present invention.

Hereinbelow, the present invention will be described in detail with reference to the accompanying drawings and the reference numerals and characters.

In a lock handle assembly which a detachable handle 43, according to the present invention: a main body 1 provided with an handle-insertion hole 2 in its front surface for receiving the detachable handle 43 therein is abutted against a front surface 56*a* of a door 56; a cover 9 is slidably mounted on the front surface of the main body 1; a mounting plate 34 for fixedly mounting the main body 1 on the door 56 is abutted against a rear surface 56*b* of the door 56; and, a plurality of screws 53 are provided, each of which screws 53 passes through a through-hole 35 of the mounting plate 34 and another through-hole 57 of the door 56 so as to be threadably connected with a threaded hole 5 of a rear wall 4 of the main body 1, whereby the main body 1 is fixedly mounted on the door 56.

Further, in the lock handle assembly of the present invention, a rotor 12 is provided with: a handle-receiving hole 13 in its front surface; and a square hole 14 in its rear surface. The rotor 12 is rotatably mounted in a cylindrical portion 3 of the main body 1.

In addition, in the handle assembly of the present invention, a cam 16 is provided with: a square-column portion 17*a* and a threaded hole 18*a* in its front-end portion; and a square-column portion 17*b* and a threaded hole 18*b* in its rear-end portion. The cam 16 has its intermediate portion formed into a pair of flat-plate portions 19*a*, 19*b* which are diametrically opposed to each other. The flat-plate portions 19*a* and 19*b* are provided with through-holes 20*a* and 20*b*, respectively. Links 22*a* and 22*b* are connected with the the pair of the through-hole 20*a* and 20*b* of the cam 16, respectively. Arms 23*a* and 23*b* are connected with a front end of the link 22*a* and a front end of the link 22*b*, respectively. A casing 25 is provided with guides 26*a*, 26*b* for the arms 23*a*, 23*b* in its inner portion. Constructed from the cam 16, links 22*a*, 22*b* and the arms 23*a*, 23*b* is a mechanism which is received in the casing 25 which has its square-column portions 17*a* and 17*b* projected from a front surface 32 and a rear surface 33 of the casing 25, respectively.

The square-column portion 17*a* thus projected from the front surface 32 of the casing 25 is fixedly mounted in the square hole 14 of the rotor 12 in an insertion manner. Each of a plurality of screws 51 passes through a through-hole 28 of a rear wall 27 of the casing 25 and is threadably engaged with a threaded hole 36 of a rear surface of the mounting plate 34, so that the casing 25 is fixedly mounted on the main body 1. Further, a catch plate 37 is fixedly mounted on the square-column portion 17*b* of the cam 16, which portion 17*b* is projected from the rear surface 33 of the casing 25.

Further, in the present invention, each of the through-holes 20*a*, 20*b* of the flat-plate portions 19*a*, 19*b* of the cam 16 is provided in each of off-set positions relative to each of longitudinal axes of the arms 23*a*, 23*b*, so that when each of the arms 23*a* and 23*b* is projected from each of the opposite end of the casing 25 to a maximum extent, each of the flat-plate portions 19*a* and 19*b* of the intermediate shaft portion 21 of the cam 16 abuts against each of guide convex portions 29*a* and 29*b* of an inner portion of the casing 25 to prevent the cam 16 from reversely rotating.

As shown in FIG. 1, in the lock handle assembly, the cover 9 is slidably moved downward to cover the handle-insertion hole 2 of the main body 1, so that dust is prevented from entering the handle-insertion hole 2.

Figure 2:
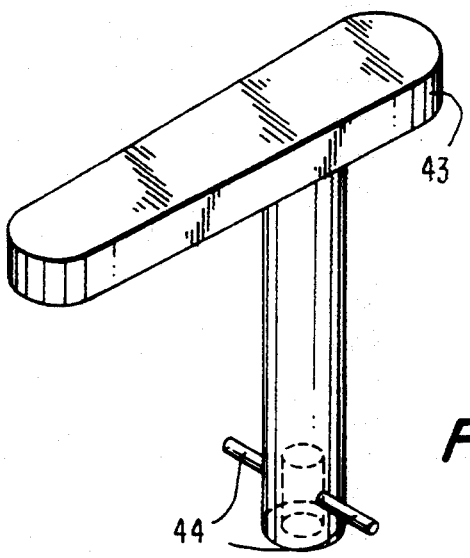
FIG. 2 is a perspective view of the detachable handle of the lock handle assembly of the present invention shown in FIG. 1.
Figure 5:
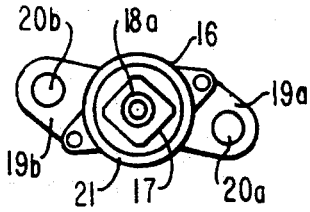
FIG. 5 is a plan view of the cam of the lock handle assembly of the present invention shown in FIG. 1.
Figure 6:
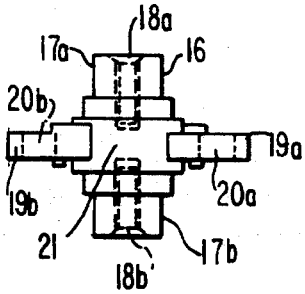
FIG. 6 is a front view of the cam shown in FIG. 5.
Figure 7:
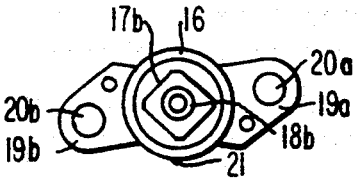
FIG. 7 is a bottom view of the cam shown in FIG. 5.
Figure 3:
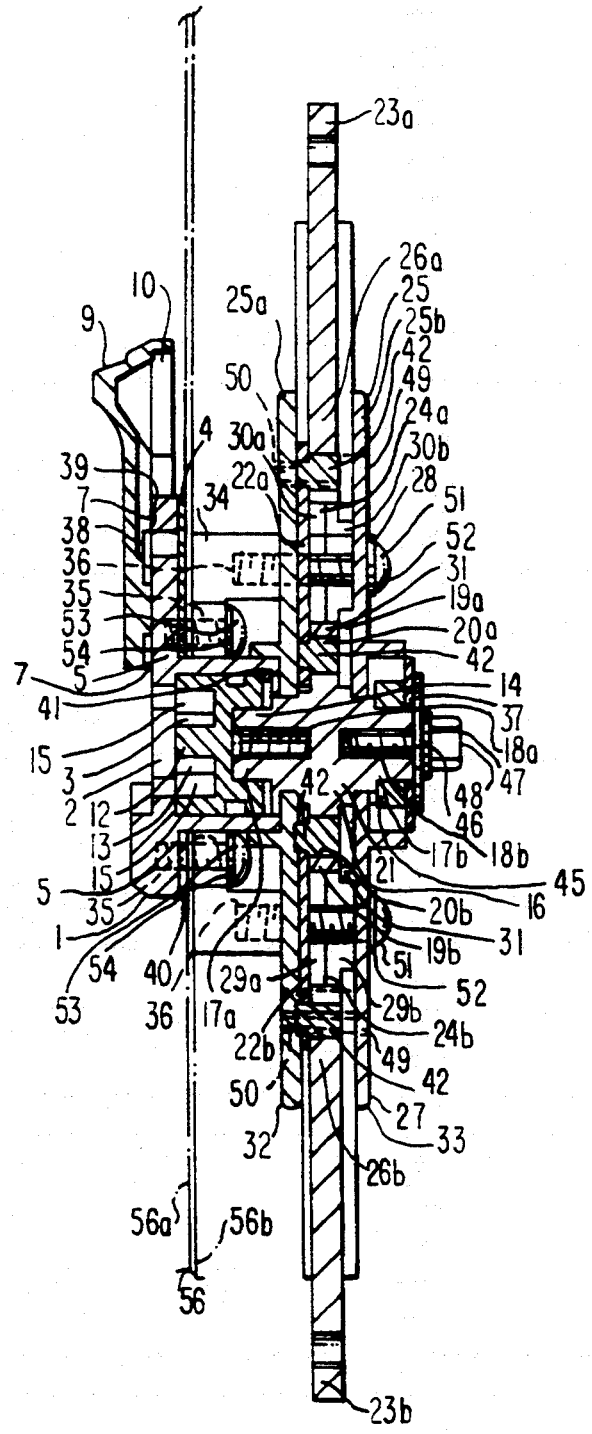
FIG. 3 is an sectional view of the lock handle assembly of the present invention, taken along the line A—A of FIG. 1.
Figure 4:
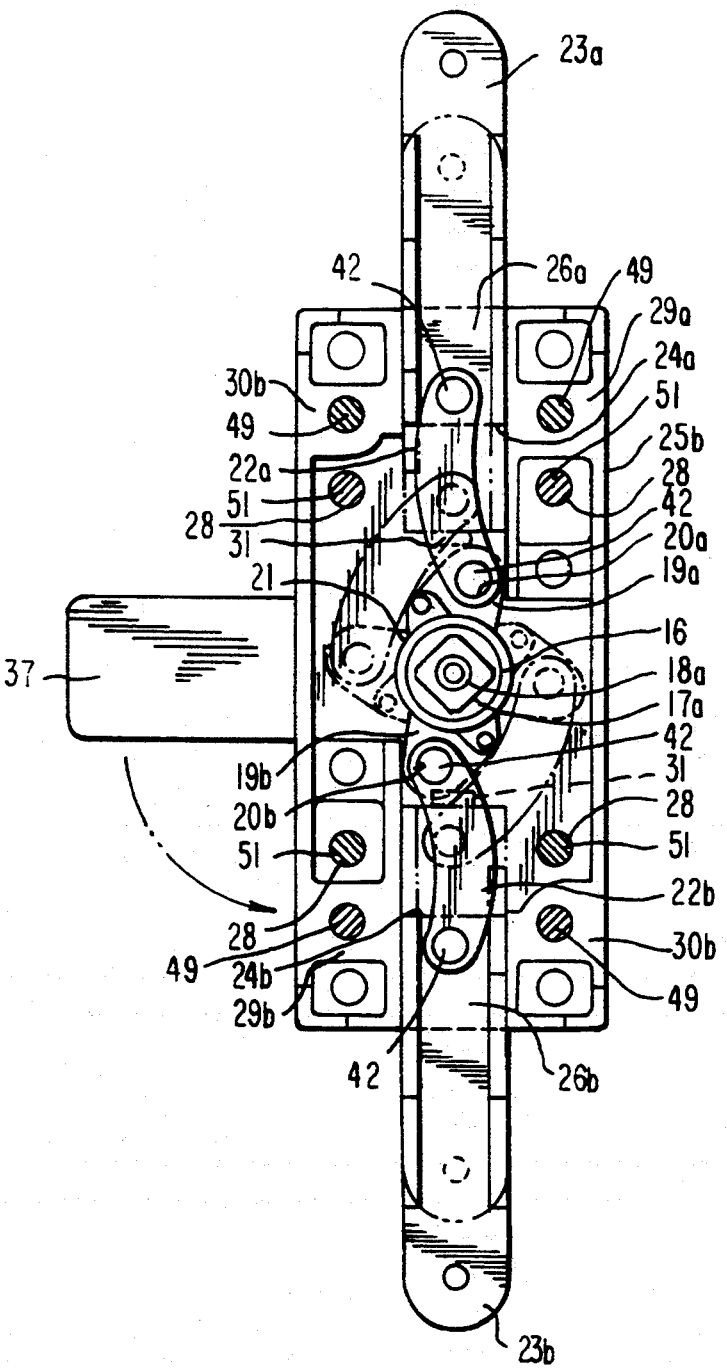
FIG. 4 is a view illustrating the cam-link mechanism of the lock handle assembly of the present invention shown in FIG. 1.
Figure 8:
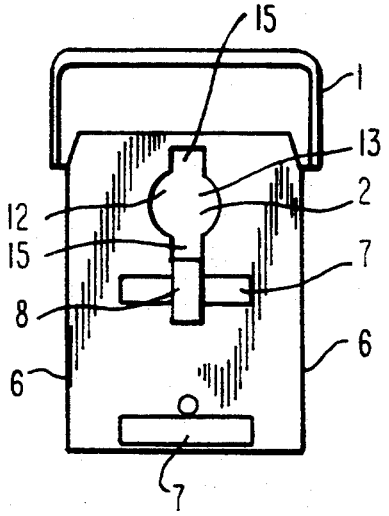
FIG. 8 is a front view of the main body of the lock handle assembly of another embodiment of the present invention.
Figure 10:
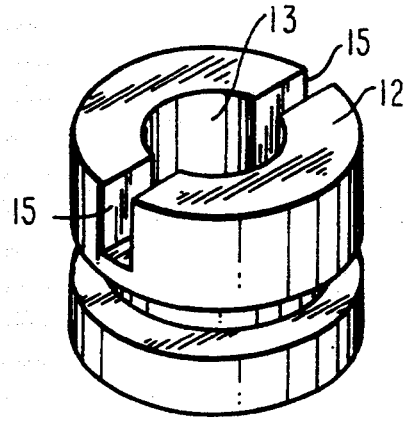
FIG. 10 is a perspective view of the rotor of the lock handle assembly of the present invention.
Figure 9:
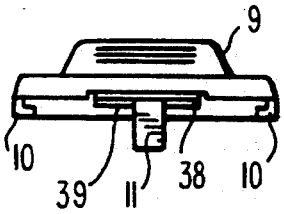
FIG. 9 is a side view of the cover of the lock handle assembly of the present invention.
Figure 11:
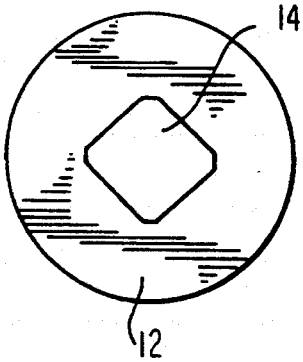
FIG. 11 is a bottom view of the rotor shown in FIG. 10.

In operation, the catch plate 37 engages with a receiving portion 59 of the stationary frame element 58 while front ends of the rods 55*a*, 55*b* engage with receiving portions 60, 61 of the stationary frame element 58, so that a three-point locking up of the door 56 is performed relative to the stationary frame element 58. In order to unlock the door 56, the cover 9 is slidably moved upward so that the handle-insertion hole 2 appears. Through the handle-insertion hole 2, a front-end portion of the detachable handle 43 as shown in FIG. 2 is inserted into the handle-receiving hole 13 of the rotor 12 so that a pair of drive projection 44 of the detachable handle 43 are engaged with a pair of slot portions 15 of the handle-receiving hole 13. Under such circumstances, the detachable handle 43 is rotated to rotatably drive the rotor 12, so that the cam 16 fixed to the rotor 12 is also rotatably driven by the detachable handle 43. As a result, the links 22*a*, 22*b* mounted on the opposite sides of the cam 16 are also rotatably driven, so that the arms 23*a*, 23*b* mounted on the front ends of the links 22*a*, 22*b* are retracted in the casing 25 while linearly guided by the guides 26*a*, 26*b* of the casing 25, whereby the front ends of the rods 55*a*, 55*b* mounted on the front ends of the arms 23*a*, 23*b* are disengaged from the receiving portions 60, 61 of the stationary frame element 58. At the same time, the catch plate 37 fixed to the rear-end portion 17*b* of the cam 16 is rotatably driven together with the cam 16 so as to be disengaged from the receiving portion 59 of the stationary frame element 58. As a result, the door 56 is entirely unlocked.

When each of the arms 23*a* and 23*b* is projected from the casing 25 to a maximum extent so that the door 56 is locked up, each of the flat-plate portions 19*a* and 19*b* of the intermediate shaft portion 21 of the cam 16 abuts against each of guide convex portions 29*a* and 29*b* of an inner portion of the casing 25 to prevent the cam 16 from reversely rotating.

In case that the door 56 is engaged with the stationary frame element 58 reversely relative to its arrangement shown in FIG. 1, the casing 25 is reversed in arrangement, and then the catch prate 37 is fixedly mounted on the square-column portion 17*a* in place of the square-column portion 17*b* which is now fixedly mounted in the square hole 14 of the rotor 12, so that the thus reversely arranged door 56 may engage with the stationary frame element 58 in the same manner as that of the embodiment shown in FIG. 1.

In the embodiment shown in FIGS. 1 to 7, nail portions 10 are provided in opposite-end rear portions of the cover 9, and engaged with a side surface 6 of the main body 1 to permit the cover 9 to be slidably moved relative to the main body 1. Further, a leaf spring 38 is provided in a rear surface of the cover 9, and has its projection 39 engaged with a concave portion 7 of the main body 1 so that the door 9 is held in a predetermined position.

The main body 1 has its four rear portions threadably engaged with the mounting plate 34 through four screws 53, so that the main body 1 is fixedly mounted on the door 55. A packing 40 is interposed between the front surface 56*a* of the door 56 and the main body 1. On the other hand, the casing 25 is fixedly mounted on the mounting plate 34 through four screws each of which passes through a rear wall 27 of the casing 25 from the rear thereof and is threadably connected with the mounting plate 34.

The casing 25 is divided into a front half 25*a* and a rear half 25*b*, and receives the mechanism (which is constructed of the cam 16, links 22*a*, 22*b* and the arms 23*a*, 23*b*) between its halves 25*a*, 25*b* which are fixedly combined with each other by means of screws 49 to form the casing 25, which screws pass through these halves 25*a*, 25*b* from the rear surface 33 of the casing 25 and are threadably connected with the casing 25. Horizontally provided in the interior of the casing 25 is the concave portion 29 comprising concave portions 29*a*, 29*b*, 30*a*, 30*b*. In the casing 25, the guides 26*a* and 26*b* are defined between: the concave portions 29*a* and 30*a*; and the concave portions 29*b* and 30*b*, respectively. The guides 26*a* and 26*b* receive therein the arms 23*a* and 23*b*, and linearly guide the arms 23*a* and 23*b*, respectively. Each of the guides 26*a*, 26*b* is provided of a stopper projection 31 which abuts against each of a base-end portions 24*a* of the arm 23*a* and a base-end portion 24*b* of the arm 23*b* to regulate the arms 23*a*, 23*b* in retraction in the casing 25.

A spacer 45 and the catch plate 37 are mounted on the square-column portion 17*b* of the cam 16 (which portion 17*b* projects rearward from the rear surface 33 of the casing 25) in an insertion manner, and fixed thereto by fastening with the bolt 48. On the other hand, the rotor 12, which is mounted in the cylindrical portion 3 of the main body 1 in an insertion manner, is prevented from dropping out of the main body 1 by a C-ring 41.

In another embodiment of the present invention shown in FIGS. 8 to 11, a projection 11 is provided in the cover 9 which is slidably mounted on the front surface of the main body 1 which is provided with a groove 8 for receiving the projection 11 therein. When the cover 9 is closed to cover the handle-insertion hole 2 of the main body 1, the projection 11 of the cover 9 engages with a recess 15 of the rotor 12 to prevent the rotor 12 from rotating, without fail.

The present invention is also applicable to a one-point or a two-point lock system in addition to the three-point lock system described above in connection with the lock handle assembly of the present invention. Further, it is possible to employ a system in which: the cover 9 is mounted on the lock unit; and the cover 9 is locked up relative to the main body 1 when the cover 9 is closed.

As described above, in the lock handle assembly with the detachable handle according to the present invention: the main body 1 is abutted against the front surface 56*a* of the door 56; the mounting plate 34 is abutted against the rear surface 56*b* of the door 56; each of the screws 53 passes through the through-hole 35 of the mounting plate 34 and the through-hole 57 of the door 56, and is threadably engaged with the threaded hole 5 of the rear wall 4 of the main body 1 so that the main body 1 is fixedly mounted on the door 55; the rotor 12, which is provided with the square hole 14 in its rear surface, is rotatably mounted in the cylindrical portion 3 of the main body 1 in an insertion manner; the cam 16 has its front square-column portion 17*a* (which projects forward from the front surface 32 of the casing 25) mounted in the square hole 14 of the rotor 12 in an insertion manner; and, each of the screws 51 passes through the through-hole 28 of the rear wall 27 of the casing 25 from the rear of the casing 25, and is threadably engaged with the threaded hole 36 of the rear surface of the mounting plate 34, so that the casing 25 is fixedly mounted on the main body 1. Consequently, since the main body 1 is fixedly mounted on the door 56 in a manner described in the above, it is possible to fixedly mount the main body 1 on the door 56 varying in thickness.

Further, in the present invention: the cam 16 is fixedly mounted on the rear-end portion of the rotor 12, and has its opposite end portions connected with the links 22*a*, 22*b* which have their front-end portions connected with the arms 23*a*, 23*b* which in turn have their front-end portions connected with the rods 55*a*, 55*b*, so that the arms 23*a*, 23*b* are linearly moved back and forth as the cam 16 rotates, whereby the front-end portions of the rods 55*a*, 55*b* are engaged with and disengaged from the receiving portions 60, 61 of the stationary frame element 58; and, at the same time, the catch plate 37 is engaged with and disengaged from the receiving portion 59 of the stationary frame element 58 as the cam 16 rotates. Consequently, in the present invention, it is possible Further, in the present invention: each of the through-holes 20*a*, 20*b* of the flat-plate portions 19*a*, 19*b* of the cam 16 is provided in each of off-set positions relative to each of longitudinal axes of the arms 23*a*, 23*b*, so that when each of the arms 23*a* and 23*b* is projected from each of the opposite end of the casing 25 to its maximum extent, each or the flat-plate portions 19*a* and 19*b* of the intermediate shaft portion 21 of the cam 16 abuts against each of the guide convex portions 29*a* and 29*b* of the inner portion of the casing 25 to prevent, the cam 16 from reversely rotating. Consequently, in the present invention, the door 56 is locked up without fail.

Further, in the present invention, the cam 16 has its front-end portion and rear-end portion provided with: the square-column portion 17*a* and the threaded hole 18*a*; and, the square-column portion 17*b* and the threaded hole 18*b*, respectively. Consequently, in the present invention, it is possible to reversely mount the door 56 on the stationary frame element 58 in arrangement by mounting the square-column portion 17*b* of the cam 16 in the square hole 14 of the rotor 12 in place of the square-column portion 17*b* of the cam 16 in the embodiment shown in FIG. 3. In other ward, according to the present invention, the door 56 can be mounted at either side thereof on the stationary frame element 58 by only interchanging the square-column portions 17*a*, 17*b* of the cam 16 being mounted in the square hole 14 of the rotor 12.

What is claimed is:

1. A lock handle assembly with a detachable handle (43), comprising:

a main body (1) provided with a handle-insertion hole (2) in its front surface;

a cover (9) slidably mounted on said front surface of said main body (1);

a mounting plate (34) for fixedly mounting said main body (1) on a door (56);

a rotor (12) which is provided with a handle-receiving hole (13) in its front surface and a square bole (14) in its rear surface, and is rotatably mounted in a cylindrical portion (3) of said main body (1);

a cam (16) which is provided with a square-column portion (17*a*) and a threaded hole (18*a*) in its front-end portion, and a square-column portion (17*b*) and a threaded hole (18*b*) in its rear-end portion, and has its intermediate portion formed into a pair of flat-plate portions (19*a*, 19*b*) which are diametrically opposed to each other, said flat-plate portions (19*a*, 19*b*) being provided with through-holes (20*a*, 20*b*), respectively;

links (22*a*, 22*b*) connected with said through-hole (20*a*, 20*b*) of said cam (16), respectively;

arms (23*a*, 23*b*) connected with a front end of said link (22*a*) and a front end of said link (22*b*), respectively;

a casing (25) provided with guides (26*a*, 26*b*) for said arms (23*a*, 23*b*) in its inner portion, said casing (25) receiving said cam (16), said links (22*a*, 22*b*), and said arms (23*a*, 23*b*) therein; and a catch plate (37) fixedly mounted on a rear-end portion (17*b*) of said cam (16);

wherein said main body (1) abuts on a front surface (56*a*) of a door (56); said mounting plate (34) abuts on a rear surface (56*b*) of said door (56); a screw (53) passes through a through-hole (35) of said mounting plate (34) and a through-hole (57) of said door (56), and is threadably connected with a threaded hole (5) of a rear wall (4) of said main body (1) so that said main body (1) is fixedly mounted on said door (56); said square-column portion (17*a*) of said cam (16) projecting from a front surface (32) of said casing (25) is inserted in said square hole (14) of said rotor (12) having been mounted in said cylindrical portion (3) of said main body (1), and then a screw (51) passing through a through-hole (28) of a rear wall (27) of said casing (25) is threadably connected with a threaded hole (36) of a rear surface of said mounting plate (34), so that said main body (1) is fixedly mounted on said casing (25); and, said catch plate (37) is fixedly mounted on said square-column portion (17*b*) of said cam (16) projecting from a rear surface (33) of said casing (25).

2. The lock handle assembly as set forth in claim 1, wherein:

each of said through-holes (20*a*, 20*b*) of said flat-plate portions (19*a*, 19*b*) of said cam (16) is provided in each of off-set positions relative to each of longitudinal axes of said arms (23*a*, 23*b*), so that when each of said arms (23*a*, 23*b*) is projected from each of the opposite ends of said casing (25) to a maximum extent, each of said flat-plate portions (19*a*, 19*b*) of said intermediate shaft portion (21) of said cam (16) abuts against each of guide convex portions (29*a*, 29*b*) of an inner portion of said casing (25) to prevent said cam (16) from reversely rotating.

3. The lock handle assembly according to claim 1, wherein said catch plate (37) is arranged to engage with a receiving portion (59) of a stationary frame element.

4. The lock handle assembly according to claim 3, wherein said arms (23*a*, 23*b*) are connected to rods (55*a*, 55*b*) which are arranged to engage with receiving portions (60, 61) so as to provide a three-point locking up of a door.

* * * * *